US006892425B2

(12) United States Patent
Smith

(10) Patent No.: US 6,892,425 B2
(45) Date of Patent: May 17, 2005

(54) REMOVABLE DOOR CHECK DEVICE

(75) Inventor: Jonathan Smith, Bloomfield Hills, MI (US)

(73) Assignee: Edscha North America, Pontiac, MI (US)

( * ) Notice: Subject to any disclaimer, the term of this patent is extended or adjusted under 35 U.S.C. 154(b) by 30 days.

(21) Appl. No.: 10/358,973

(22) Filed: Feb. 5, 2003

(65) Prior Publication Data

US 2004/0148739 A1 Aug. 5, 2004

(51) Int. Cl.[7] ..... E05D 11/06

(52) U.S. Cl. ..... 16/374; 16/82; 16/86 B; 16/DIG. 17

(58) Field of Search ..... 16/82, 83, 86 A, 16/86 B, 374, 334, 375, DIG. 17

(56) References Cited

U.S. PATENT DOCUMENTS

| | | | | | |
|---|---|---|---|---|---|
| 2,133,351 | A | * | 10/1938 | Birkelund | 16/375 |
| 3,773,369 | A | * | 11/1973 | Wersonick | 292/150 |
| 4,738,002 | A | * | 4/1988 | Shank | 16/82 |
| 5,335,396 | A | * | 8/1994 | Dolan | 16/82 |
| 5,577,295 | A | | 11/1996 | Papke et al. | 16/254 |
| 5,924,170 | A | | 7/1999 | Papke et al. | 16/321 |
| 6,108,866 | A | | 8/2000 | Waynick, Jr. | 16/82 |
| 6,178,599 | B1 | * | 1/2001 | Worden et al. | 16/386 |
| 6,332,243 | B1 | | 12/2001 | Kim | 16/334 |
| 6,334,236 | B1 | | 1/2002 | Kalliomaki | 16/334 |
| 6,360,407 | B1 | * | 3/2002 | Webster et al. | 24/570 |
| 6,430,835 | B1 | | 8/2002 | Ranucci et al. | 33/645 |
| 2003/0140455 | A1 | * | 7/2003 | Audisio | 16/334 |

FOREIGN PATENT DOCUMENTS

| | | | | |
|---|---|---|---|---|
| DE | 3418891 A1 | * | 11/1985 | E05D/11/10 |
| EP | 797718 B1 | * | 4/2000 | E05C/17/04 |
| WO | WO 200034608 A1 | * | 6/2000 | B60J/5/04 |

* cited by examiner

*Primary Examiner*—Chuck Y. Mah
(74) *Attorney, Agent, or Firm*—Davidson, Davidson & Kappel, LLC

(57) ABSTRACT

A removable door check device for holding a vehicle door hinge in an opened position includes a body, first and second leg portions extending from the body and disposed coplanar to the body, a protrusion portion extending from the body in a direction perpendicular to the body. In addition, a door hinge that includes a first hinge part, a second hinge part, a hinge pin passing through the first and second hinge parts and a removable door check device. The first and second hinge parts are pivotable about the hinge pin between an opened and a closed position. The removable door check device of the hinge is disposed on the hinge pin exterior to the first and second hinge parts engaging the second hinge part in the opened position.

18 Claims, 4 Drawing Sheets

REMOVABLE DOOR CHECK DEVICE

BACKGROUND OF THE INVENTION

The present invention relates generally to a door check device, and more particularly to a removable door check device for use with a door hinge for holding a vehicle door in an opened position. The present invention also relates to a door hinge including a removable door check device.

During the manufacture of vehicles, the vehicle body and doors are typically painted together in a single process step after the doors have been mounted to the vehicle. It may be desirable to keep the vehicle doors held in an opened position temporarily so that the certain painting operations can be performed.

U.S. Pat. No. 6,334,236 describes a vehicle door prop clip for a vehicle hinge having split hinge pins. The prop clip is mounted onto the vehicle hinge by placing a sleeve member of the prop clip over one of the hinge pins in the split-pin hinge. The prop clip includes two lobes which compress as one hinge part is pivoted with respect to the other hinge part and contact the lobes. A disadvantage of the this device is that it is only useable on hinges having split pins, and in which at least one of the split pins is accessible.

U.S. Pat. No. 6,332,243 describes a door check mechanism that includes first and second hinge parts rotatably connected on an axis of rotation. The mechanism includes a third, intermediate, hinge part that is also rotatably connected on hinge pins about the axis of rotation and includes a cam surface. A flexible prop button is mounted to one of the first and second hinge parts and is adapted to releasably contact the cam surface of the intermediate hinge part as the door is rotated about the hinge to releasably hold the door in an opened position. A disadvantage to this solution is that it requires a permanent additional moving part (the intermediate hinge part) to be added to the hinge. Only the prop button is removable after the painting process, while the intermediate hinge part remains permanently as part of the hinge.

U.S. Pat. No. 6,108,866 describes a resilient detent mechanism for selectively maintaining a vehicle door in an opened position. The detent mechanism is mounted to the hinge by engagement with the hinge pin of the door. As the door is moved to a fully opened position, a corner of the mechanism interferes with a portion of the hinge and is compressed. Like the devices described above, this one requires access to the hinge pin to function.

BRIEF SUMMARY OF THE INVENTION

An object of the present invention is to provide a low cost and effective removable door check device that can be mounted on a hinge pin of a vehicle hinge at a position exterior to the other hinge components. An additional or alternate object of the invention is to provide a door check device that can function independent of the geometry of the hinge pin (or hinge pins) and internal geometry of the hinge parts between the ends of the hinge pin. An additional or alternate object of the invention is to provide a door check device that can function with existing hinge designs and/or without requiring additional components for the hinge with which it is used.

The present invention provides a door hinge that includes a first hinge part, a second hinge part, a hinge pin passing through the first and second hinge parts and a removable door check device. The first and second hinge parts are pivotable about the hinge pin between an opened and a closed position. The removable door check device is disposed on the hinge pin exteriorly to the first and second hinge parts and engaging the second hinge part in the opened position.

The removable door check device preferably includes first and second leg portions that abut against the first hinge part. The first and second leg portions may extend from a body of the removable door check device, so as to be coplanar with the body and to straddle the hinge pin.

The removable door check device preferably also includes a protrusion extending perpendicularly from the body for engaging a hole in the second hinge part. The protrusion is preferably tapered. The body may define a longitudinal axis and the leg portions may extend parallel with each other and at an angle to the longitudinal axis. The removable door check device may include a tab handle extending at an obtuse angle from the body.

The door check device is preferably integrally formed from a single piece of material, preferably metal.

The present invention also provides a removable door check device for holding a vehicle door hinge in an opened position. The removable door check device includes a body, first and second leg portions extending from the body and disposed coplanar to the body, as well as a protrusion extending from the body in a direction perpendicular to the body.

Where the body defines a longitudinal axis, the first and second leg portions may define an arcuate inner surface portion between the first and second leg portions. A center point of the arcuate inner surface (i.e. the point from which a radius of the arcuate surface extends) lies on the longitudinal axis. The protrusion may define a protrusion axis intersecting with the longitudinal axis.

BRIEF DESCRIPTION OF THE DRAWINGS

Several embodiments of the present invention are elaborated upon below with reference to the accompanying drawings, in which.

DETAILED DESCRIPTION

Figure 1:
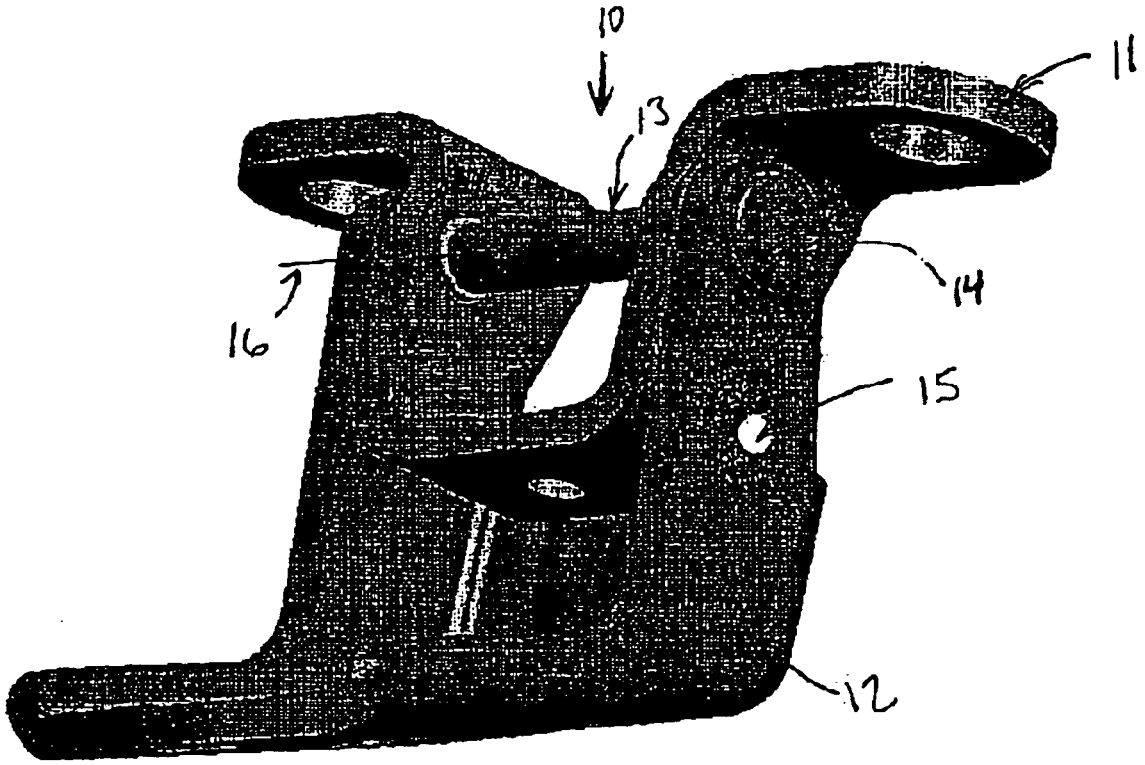
Fig. 1 (Prior Art)
FIG. 1 shows a perspective view of a typical vehicle door hinge, with which a removable door check device according to the present invention may be used.

A typical vehicle door hinge 10 is shown in FIG. 1. Door hinge 10 includes first hinge part 11 and second hinge part 12 pivotably connected to first hinge part 11 about hinge axis 16. Hinge parts and 11 and 12 are shown in an opened position in FIG. 1, and are pivotably with respect to each other about hinge pin 13 between the open position (shown) and a closed position. One of the first and second hinge parts 11 and 12 is connected to a vehicle door and the other is connected to a body of the vehicle. Hinge pin 13 passes having near end 14 passes through hinge axis 16 and connects first and second hinge parts 11, 12 to one another. In some vehicle hinges, instead of a single hinge pin 15 spanning from one side of the hinge 10 to the other, split pins are used, with one pin on each side of the hinge. In other vehicle hinges, for example hinge 50 shown in FIG. 6, one of the first and second hinge parts 51, 52 may include a sleeve portion surrounding the hinge pin.

Figure 2:
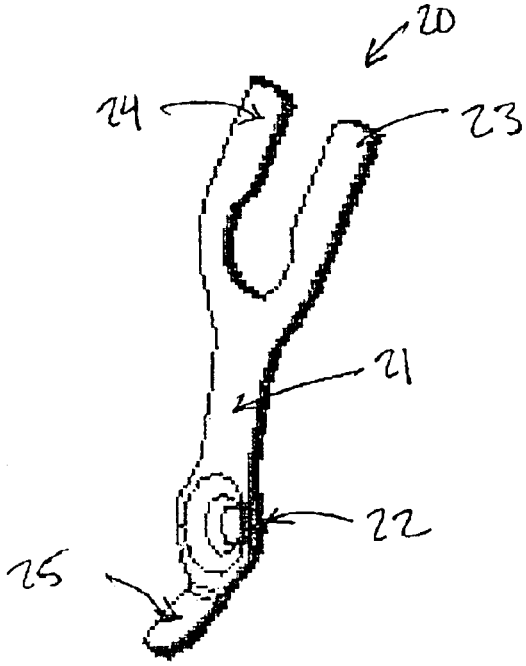
FIG. 2 shows a perspective view of an embodiment of a removable door check device according to the present invention.
Figure 3:
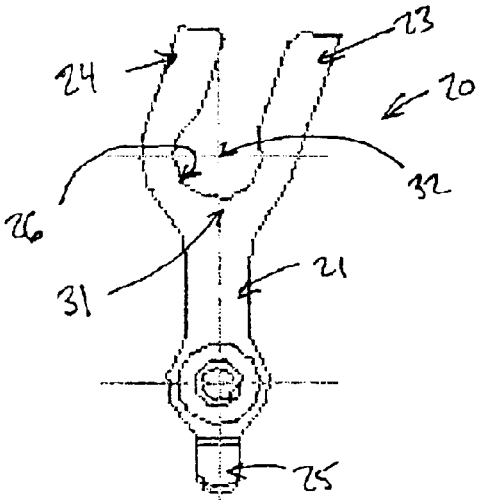
FIG. 3 shows a front view of the embodiment shown in FIG. 2.
Figure 4:
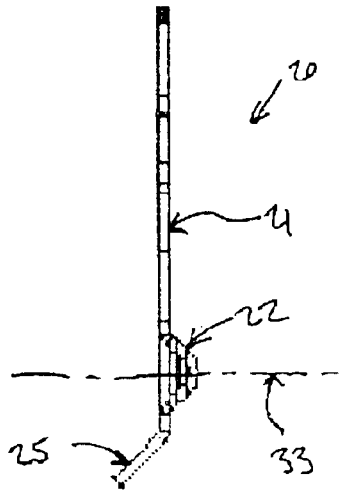
FIG. 4 shows a side view of the embodiment shown in FIG. 2.

A first embodiment of a removable door check device 20 according to the present invention is shown in FIGS. 2, 3, and 4. Removable door check device 20 includes body 21 and leg potions 23 and 24 extending from body 21 and coplanar with body 21. Leg portions 23 and 24 are disposed parallel to one another, but at an angle to longitudinal axis 31 defined by body 21. Tab handle 25 extends at an angle from body 21, and tapered protrusion 22 extends perpendicular to body 21. Tapered protrusion 22 defines protrusion axis 33, which intersects perpendicularly with longitudinal axis 31. Leg portions 23 and 24 include an arcuate inner surface 26 therebetween. Center point 32 of arcuate surface 26, (i.e. the point from which a radius of the arcuate surface extends), lies on longitudinal axis 31. Removable door check device 20 is preferably integrally formed from a single piece of a flexible material such as a single strip of metal, and may be formed by stamping.

Figure 5:
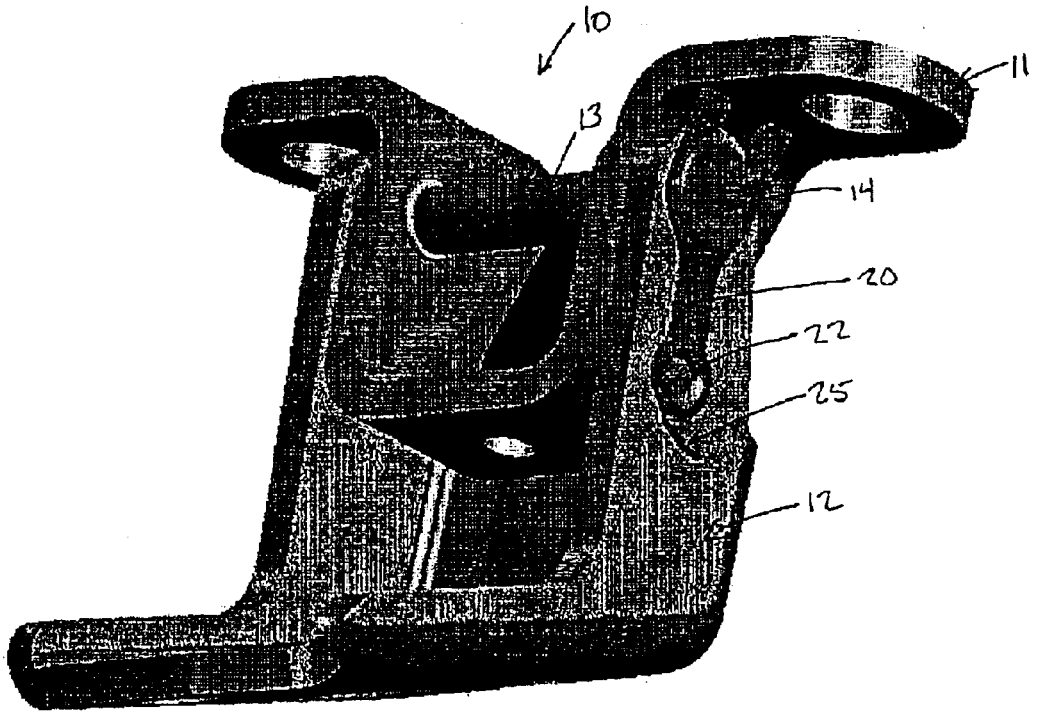
FIG. 5 shows a perspective view of the embodiment shown in FIG. 2 together with the hinge of FIG. 1.

As shown in FIG. 5, removable door check device 20 is configured to be attached to hinge 10 so that leg portions 23 and 24 straddle hinge pin 13 at a location exterior to first and second hinge parts 11 and 12 (i.e. between end 14 of hinge pin 13, and outer hinge part 12). Door check device 20 is dimensioned such that when arcuate surface 26 is adjacent a circumferential surface of the hinge pin 13, protrusion 22 is aligned with hole 15 in second hinge part 12. In addition, the ends of leg portions 23 and 24 abut against an upper surface of first hinge part 11.

The removable door check device 20 may be attached to hinge pin 13 by first moving a vehicle door to an opened position, thus providing access to the vehicle hinge 10, which is also in its opened position. By holding tab handle 25, leg portions 23 and 24 are slid around hinge pin 13 through a space between end 14 and second hinge part 12, so that leg portions 23 and 24 straddle hinge pin 13. The device 20 is slid down around hinge pin 13 until the ends of leg portions 23 and 24 abut against first hinge part 11. In this position, the circumference of hinge pin 13 is adjacent arcuate surface 26, and protrusion 22 is aligned with hole 15 in second hinge part 12. By releasing tab handle 25 at this point, the resilient nature of the device acts as a spring force, causes protrusion 22 to engage hole 15 of second hinge part 12. Due to the engagement of protrusion 22 and the abutment of legs 23 and 24, the relative positions of first and second hinge parts 11 and 12 are held in the opened position.

If an external closing force is placed on hinge 10 (such as by placing a closing force on the door), a relative movement in the closing direction between hinge parts 11 and 12 is resisted by device 20 due to the abutment of leg portions 23 and 24 against first hinge part 11 together with the frictional engagement of protrusion 22 with hole 15 of second hinge part 12. If the external closing force is great enough, the contact between an edge of the hole 15 and the tapered surface of protrusion 22 will force protrusion 22 out of the hole, thus releasing the engagement between the protrusion 22 and the second hinge part 12. The stiffness of the device and the shape of the tapered protrusion can be adjusted in order to require a greater or lesser external force for releasing the engagement.

Once the engagement is released, the hinge parts are able to pivot freely relative to one another. During relative rotation of the hinge parts 11 and 12, device 20 will remain in a constant rotational position with respect to first hinge part 11 due to the abutment of leg portions 23 and 24 against hinge part 11 and the contact between arcuate inner surface 26 and hinge pin 13. When hinge 10 is again moved toward the opened position, a leading edge of the second hinge part 12 will contact the tapered surface of protrusion 22, thus causing body 21 to flex until the protrusion 22 rides on an outer side of hinge part 12. When hinge 10 reaches the opened position, hole 15 becomes aligned with protrusion 22 which falls into hole 15 to again hold hinge 10 in the opened position.

Door check device 20 may be removed again from hinge 10 by lifting tab 25 and thereby flexing body 21 and lifting protrusion 22 out of hole 15 in second hinge part 12, and then sliding the device 20 and legs 23 and 24 out from the space between end 14 of pin 13 and the second hinge part 12.

Figure 6:
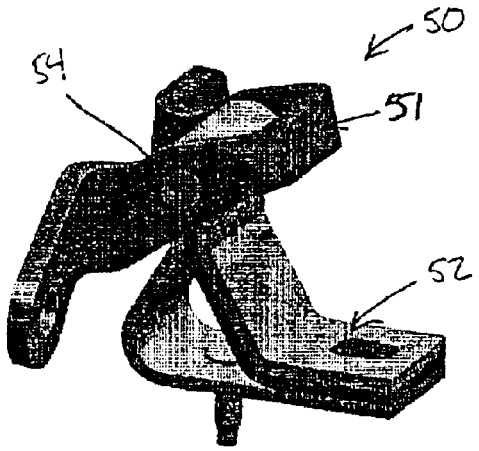
FIG. 6 shows a second example of a vehicle door hinge.
Figure 7:
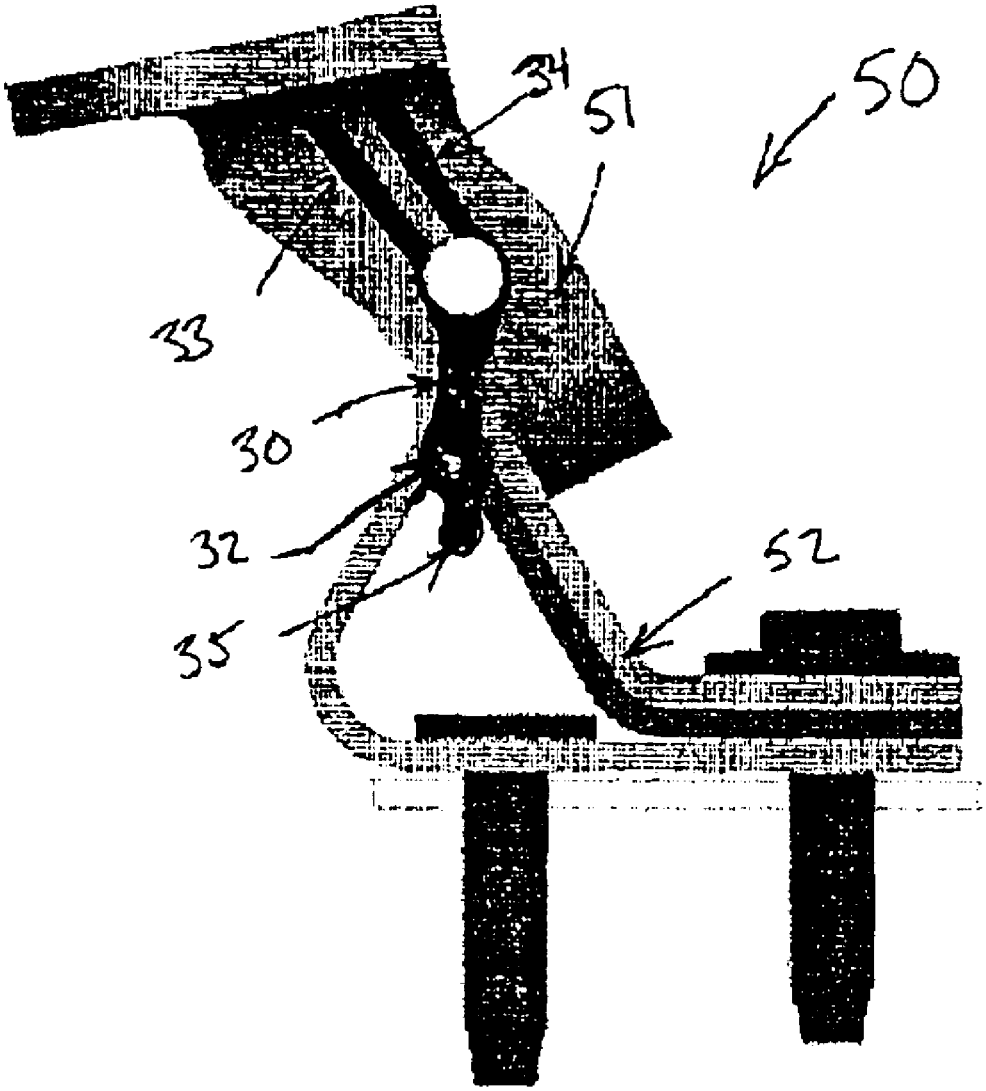
FIG. 7 shows the second example of the vehicle door hinge of FIG. 6 together with a second embodiment of a removable door check device according to the present invention.

A second example of a vehicle door hinge 50 is shown in a closed position in FIG. 6 and in an opened position in FIG. 7. Vehicle hinge 50 includes first hinge part 51 and second hinge part 52. FIG. 7 shows vehicle hinge 50 together with second embodiment of removable door check device 30. First and second legs 33 and 34 extend parallel and coplanar with each other and straddle the hinge pin between an end 54 of the hinge pin and first hinge part 51. Ends of leg portions 33 and 34 abut against first hinge part 51. Protrusion 32 extends in a direction perpendicular to legs 33 and 34 and engage the triangular hole in second hinge part 52 when hinge 50 is in an opened position. Removable door check device 30 holds vehicle hinge 50 in the opened position due to the frictional engagement between protrusion 32 and second hinge part 52 on the one hand, and the abutment of leg portions 33 and 34 against first hinge part 51 on the other hand.

Tab 35 can be used to flex the door check device 30 so as to disengage protrusion 32 from the triangular hole of second hinge part 52 and to slide legs 33 and 34 out from between end 54 and first hinge part 51, thus removing door check device 30 from hinge 50.

It will of course be understood that the present invention has been described above only by way of example and that modifications of details can be made within the scope of the invention.

What is claimed is:

1. A door hinge comprising:

a first hinge part;

a second hinge part;

a hinge pin passing through the first and second hinge parts, first and second hinge parts being pivotable about the hinge pin between an opened and closed position; and a removable door check device including first and second leg portions disposed on the hinge pin exteriorly to the first and second hinge parts and engaging the second hinge part in the opened position with the first and second leg portions abutting against the first hinge part.

2. The door hinge as recited in claim 1 wherein the first and second leg portions extend from a body of the removable door check device, first and second leg portions straddling the hinge pin and being disposed in a plane with the body.

3. The door hinge as recited in claim 2 wherein the removable door check device further includes a protrusion extending from the body perpendicular to the plane for engaging a hole in the second hinge part.

4. The door hinge as recited in claim 3 wherein the protrusion is tapered.

5. The door hinge as recited in claim 2 wherein the body defines a longitudinal axis and wherein the leg portions extend parallel with each other and at an angle to the longitudinal axis.

6. The door hinge device as recited in claim 1 wherein the door check device is integrally formed from a single piece of material.

7. The door hinge as recited in claim 6 wherein the material is metal.

8. The door hinge as recited in claim 3 wherein the removable door check device includes a tab handle extending at an angle from the body.

9. The door hinge as recited in claim 1 wherein the removable door check device engages the second hinge part in a releasable manner.

10. A removable door check device for holding a vehicle door hinge in an open position comprising:

A body;

First and second leg portions extending from the body and disposed in a plane with the body; and A protrusion extending from the body in a direction perpendicular to the plane, and Wherein the body defines a longitudinal axis and wherein the first and second portions each includes an arcuate inner surface portion facing the longitudinal axis.

11. The removable door check device as recited in claim 12 wherein the protrusion defines a protrusion axis intersecting with the longitudinal axis.

12. The removable door check device as recited in claim 10 wherein each said arcuate inner surface portion has a center point lying on the longitudinal axis.

13. The removable door check device as recited in claim 10 wherein the protrusion is tapered.

14. The removable door check device as recited in claim 10 wherein the body, leg portions, and protrusion are integrally formed from a single piece of material.

15. The removable door check device as recited in claim 14 wherein the material is metal.

16. The removable door check device as recited in claim 10 further comprising a tab handle extending at an angle from the body.

17. The removable door check device as recited in claim 12 wherein the leg portions extend at an angle from the longitudinal axis.

18. A method for placing a removable door check device on a vehicle door hinge having a first hinge part, a second hinge part pivotable with respect to each other about a hinge pin between an opened and a closed position, the door check device including a protrusion and first and second leg portions, the method comprising:

sliding the door check device between an end of the hinge pin and one of the first and second hinge parts so that the first and second leg portions straddle the hinge pin and abut against the first hinge part; and engaging the protrusion into a hole of the second hinge part when the door hinge is in the opened position.

* * * * *